US007651163B2

(12) United States Patent
Jaskot et al.

(10) Patent No.: US 7,651,163 B2
(45) Date of Patent: Jan. 26, 2010

(54) LUMBAR SUPPORT DEVICE

(75) Inventors: Jan Jaskot, Markham (CA); Juliana Haddad-Jaskot, Toronto (CA)

(73) Assignee: Logicback, Inc., Thornhill, Ontario (CA)

( * ) Notice: Subject to any disclaimer, the term of this patent is extended or adjusted under 35 U.S.C. 154(b) by 1516 days.

(21) Appl. No.: 10/308,147

(22) Filed: Dec. 2, 2002

(65) Prior Publication Data

US 2004/0104610 A1 Jun. 3, 2004

(51) Int. Cl.
*A47C 7/42* (2006.01)
*A47C 7/02* (2006.01)

(52) U.S. Cl. ..... 297/284.5; 297/230.1; 297/230.11; 297/463.63

(58) Field of Classification Search ..... 297/284.5, 297/284.4, 230.14, 230.1, 230.12, 230.13, 297/284.9, 452.63, 397, DIG. 6, 452.12, 297/452.29, 452.3, 452.31, 452.33, 452.34, 297/452.36, 284.7, 411.24, 411.41, 411.36, 297/452.64, 284.3, 228.1, 230.11; 5/632, 5/630, 633; 128/876; 2/311
See application file for complete search history.

(56) References Cited

U.S. PATENT DOCUMENTS 1,975,586 A 10/1934 Law
2,182,253 A 12/1939 Farrell
2,304,349 A 12/1942 Fox
2,504,190 A 4/1950 Farrell
2,582,115 A 1/1952 Goodeve
2,621,714 A * 12/1952 Kiwad ..... 297/118
2,769,485 A * 11/1956 Shapiro ..... 297/452.32
3,197,255 A * 7/1965 Caudill ..... 297/452.36
3,695,706 A * 10/1972 Basher et al. ..... 297/452.56

(Continued)

FOREIGN PATENT DOCUMENTS

DE 3707926 A1 * 9/1988

(Continued)

OTHER PUBLICATIONS

WordNext [online] copyright Princeton University, 2006 [retrieved from the Internet on Jan. 4, 2008] <URL: http://wordnet.princeton.edu/perl/webwn?s=rigid>.*

*Primary Examiner*—David Dunn
*Assistant Examiner*—Erika Garrett
(74) *Attorney, Agent, or Firm*—Kirton & McConkie; Evan R. Witt

(57) ABSTRACT

A lumbar support device that is adjusted to a user's neutral postural position when the user is standing, and that is subsequently used to reinforce the user's neutral postural position when the user is seated. The device includes a rigid shell and an adjustable lumbar support surface. The lumbar support surface is a plurality of inelastic straps of adjustable length disposed horizontally between the sides of the rigid shell. The user adapts the straps to conform to the user's back when in a standing neutral position. When seated, the straps maintain their adjusted lengths, so as to reinforce the user's neutral position. The device includes a covering and a padding between the covering and the straps. The lumbar support device features downwardly depending legs at each side so as to support the device when placed in a chair and position the surface in the lumbar region above the chair. The gap between the legs and below the back of the shell provides a cutout to accommodate protrusion of the user's buttocks, allowing the user to adopt normal buttock positioning on the seat of the chair.

27 Claims, 8 Drawing Sheets

U.S. PATENT DOCUMENTS 3,880,463 A 4/1975 Shephard et al.
4,076,022 A * 2/1978 Walker ..... 128/892
4,313,637 A 2/1982 Barley
4,422,454 A * 12/1983 English ..... 128/870
4,471,993 A * 9/1984 Watson ..... 297/284.5
4,556,254 A * 12/1985 Roberts ..... 297/452.36
4,597,386 A * 7/1986 Goldstein ..... 602/19
4,602,816 A * 7/1986 Chandler ..... 296/63
4,634,176 A * 1/1987 Scott ..... 297/284.5
4,685,739 A * 8/1987 Deegener et al. ..... 297/452.65
4,696,291 A * 9/1987 Tyo ..... 602/19
4,819,278 A * 4/1989 Ramos ..... 4/254
4,940,284 A 7/1990 Nagasaka
4,976,387 A * 12/1990 Spianti ..... 224/262
4,981,325 A * 1/1991 Zacharkow ..... 297/284.1
5,012,798 A * 5/1991 Graf et al. ..... 602/19
5,092,319 A * 3/1992 Grim ..... 602/27
5,114,209 A 5/1992 Dunn
5,127,422 A * 7/1992 Colon ..... 5/655
5,178,163 A * 1/1993 Yewer, Jr. ..... 128/876
5,344,211 A 9/1994 Adat et al.
5,403,067 A * 4/1995 Rajaratnam ..... 297/230.14
5,407,248 A * 4/1995 Jay et al. ..... 297/284.1
5,407,422 A * 4/1995 Matthijs et al. ..... 602/19
5,411,316 A * 5/1995 Lovegrove et al. ..... 297/452.15
5,445,436 A * 8/1995 Kemnitz ..... 297/452.63
5,474,358 A 12/1995 Maeyaert
5,499,965 A * 3/1996 Sanchez ..... 602/19
5,501,507 A 3/1996 Hummitzsch
5,507,720 A * 4/1996 Lampropoulos ..... 602/27
5,551,752 A 9/1996 Lovegrove et al.
5,553,917 A 9/1996 Adat et al.
5,564,788 A 10/1996 Warhaftig
5,586,969 A * 12/1996 Yewer, Jr. ..... 602/19
5,599,063 A * 2/1997 Lister et al. ..... 297/325
5,613,736 A * 3/1997 Schaked et al. ..... 297/397
5,624,158 A 4/1997 Adat et al.
D381,081 S * 7/1997 Okada ..... D24/190
5,645,080 A * 7/1997 Toso ..... 128/876
5,647,637 A * 7/1997 Jay et al. ..... 297/354.12
5,669,665 A * 9/1997 Nowak ..... 297/406
5,797,652 A 8/1998 Darbyshire
5,803,544 A * 9/1998 Block et al. ..... 297/284.3
5,842,475 A * 12/1998 Duback et al. ..... 128/846
5,868,463 A * 2/1999 MacKenzie et al. .... 297/228.12
5,895,096 A * 4/1999 Massara ..... 297/452.34
5,988,757 A * 11/1999 Vishey et al. ..... 297/452.31
6,027,171 A * 2/2000 Partington et al. ..... 297/452.18
6,059,370 A * 5/2000 Kanyer et al. ..... 297/452.36
6,092,871 A 7/2000 Beaulieu
6,102,879 A * 8/2000 Christensen et al. ..... 602/19
6,139,109 A * 10/2000 Lajoie ..... 297/452.28
6,250,713 B1 * 6/2001 Grohs et al. ..... 297/183.6
6,257,664 B1 * 7/2001 Chew et al. ..... 297/284.9
6,299,248 B1 * 10/2001 Gennaro et al. ..... 297/230.13
6,305,749 B1 * 10/2001 O'Connor et al. ..... 297/397
6,311,346 B1 * 11/2001 Goldman ..... 5/81.1 T
6,417,294 B1 7/2002 Obuchi et al.
6,536,791 B1 * 3/2003 Adams ..... 280/250.1
6,601,804 B2 * 8/2003 Bisch ..... 248/118
6,840,125 B1 * 1/2005 Reynolds et al. ..... 73/866.4
6,959,964 B1 * 11/2005 Zapf ..... 297/230.14
6,971,717 B1 * 12/2005 Rhodes ..... 297/230.1

FOREIGN PATENT DOCUMENTS

DE 19642765 4/1997
EP 0154582 A2 * 2/1985
EP 1254616 11/2002
GB 2373179 9/2002
WO WO 01/60209 8/2001

* cited by examiner

LUMBAR SUPPORT DEVICE

FIELD OF THE INVENTION

This invention relates to a support device for correcting posture when seated and, in particular, to a lumbar support device.

BACKGROUND OF THE INVENTION

Poor posture during prolonged sitting activities has been identified as the root problem of the growing number of back, neck, extremity pain, and repetitive strain injuries being reported.

Back support devices for cushioning and supporting the user's back while the user is seated are well known. For example, a back support device is described in U.S. Pat. No. 5,403,067 to Rajaratnam. The back support device described by Rajaratnam cushions and cradles a user's back, deforming to adopt the shape of the user's back and to provide lateral pressure.

A significant drawback of the Rajaratnam device is that it does not correct or modify the user's poor sitting posture, but rather the device allows the user to assume his or her sitting posture and the device then molds to the user. Many users will adopt a poor posture, especially when seated, causing the spine to misalign, which exacerbates any back or neck pain. Accordingly, such devices are prone to misuse and fail to adequately address the issue of poor sitting posture.

Another shortcoming of devices like that described by Rajaratnam is that when it is placed in a chair its lower thickness effectively shortens the depth of the seat of the chair, thereby causing the user to sit too far forward on the seat. In some devices, this will also result in a user leaning too far backwards in the chair in order to bring his or her upper back into contact with the upper part of the chair. Most chairs are reasonably well designed to provide adequate leg and upper back support, and are sized to have an appropriate seat area. Where most chairs fail to provide adequate proper support is in the lumbar region.

When considering proper posture, it is important to note that proper posture is unique to an individual. The correct fit of an ergonomic device for one user's posture will not be the correct fit for another.

SUMMARY OF THE INVENTION

The present invention provides a lumbar support device that reinforces a user's proper spinal alignment. Moreover, it provides a device that may be easily customized to a particular user's proper posture and it then reinforces that proper posture when the user is seated.

The present invention also provides a lumbar support device that rests upon the seat of a chair without interfering with the position of the user's buttocks on the seat.

In one aspect, the present invention provides a lumbar support device including a rigid shell having a back portion between opposing sides, the sides extending forwardly of the back portion and defining a hollow, and an inelastic lumbar support surface having one end attached to one of the sides and another end attached to the other side such that the surface partially encloses the hollow, the surface having an adjustable contour.

In another aspect, the present invention provides a lumbar support device including a rigid shell having a back portion between opposing sides, the sides extending forwardly of the back portion and defining a hollow, and a plurality of inelastic straps, each of the straps spanning from one of the sides to the other side, and each of the straps having an adjustable length, the straps defining a surface that partially encloses the hollow, the surface having an adjustable contour.

In yet another aspect, the present invention provides a lumbar support device that includes a body having opposing sides and a lumbar support surface between the sides for engaging a user's lumbar region and two legs, each of the legs depending downwardly from a respective one of the opposing sides, the legs defining a gap below the body and thereby accommodating the protrusion of the user's buttocks through the gap below the body.

BRIEF DESCRIPTION OF THE DRAWINGS

Reference will now be made, by way of example, to the accompanying drawings which show an embodiment of the present invention, and in which:

FIGS. 4(*e*) to (*g*) shows a cross-sectional view of the shell and straps of FIG. 3, along the line A-A.

DESCRIPTION OF SPECIFIC EMBODIMENTS

Figure 1:
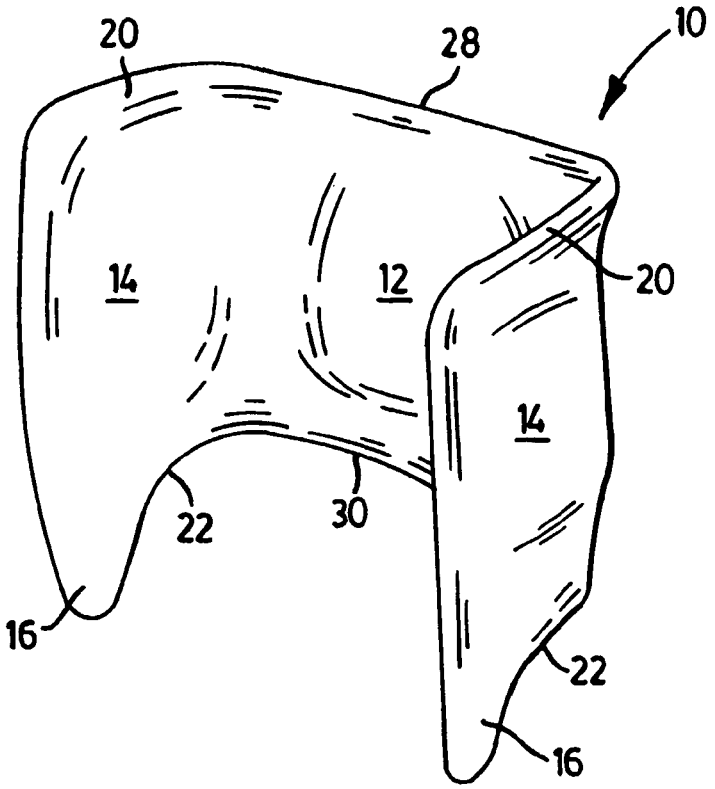
FIG. 1 shows a perspective view of a shell for a lumbar support device according to the present invention.
Figure 2A:
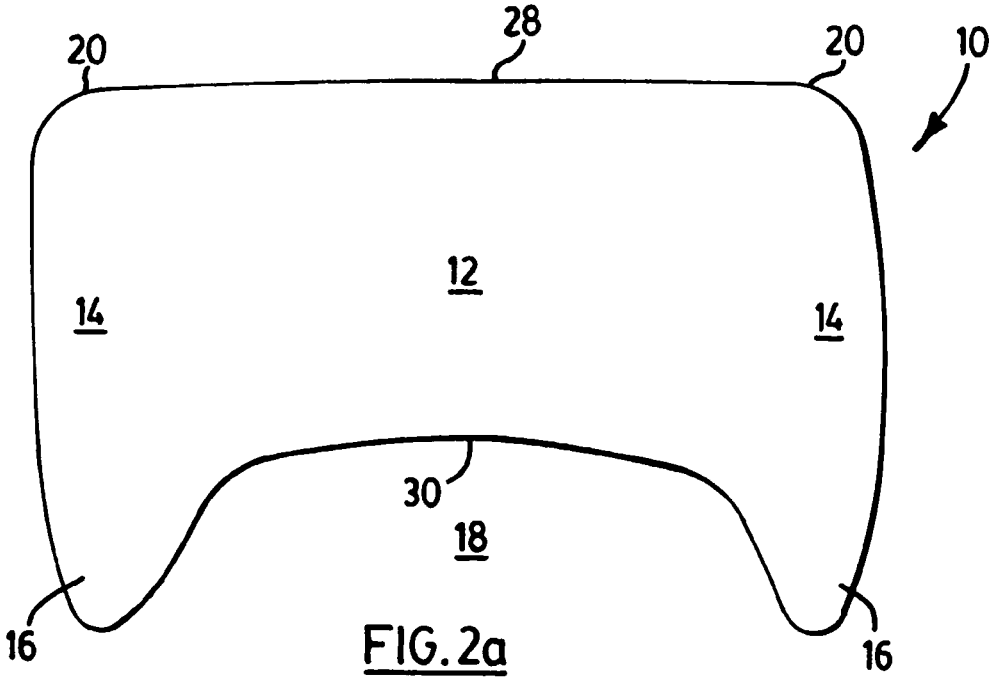
FIGS. 2(*a*) to (*c*) show front, top, and side views, respectively, of the shell of FIG. 1.
Figure 2B:
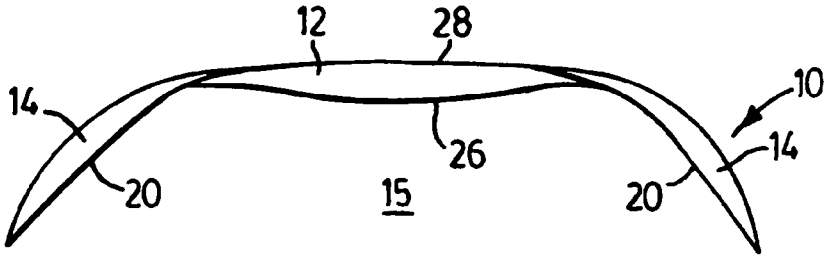
Figure 2C:
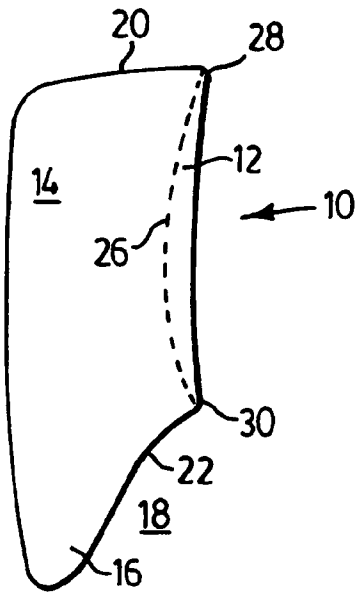
Figure 4A:
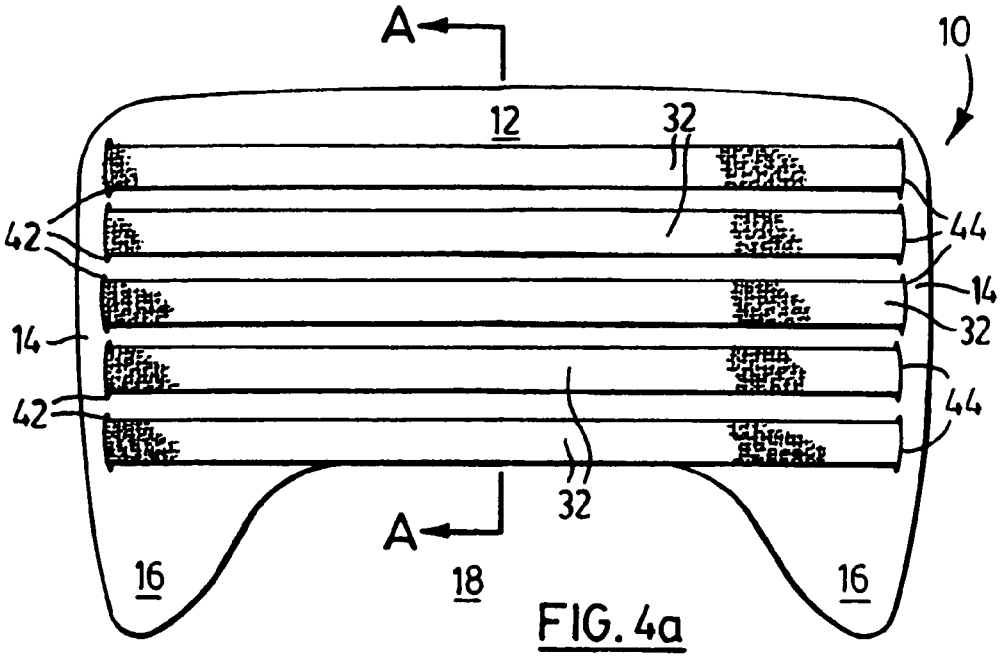
FIGS. 4(*a*) to (*d*) show front, top, right side and left side views, respectively, of the shell and straps of FIG. 3.
Figure 4B:
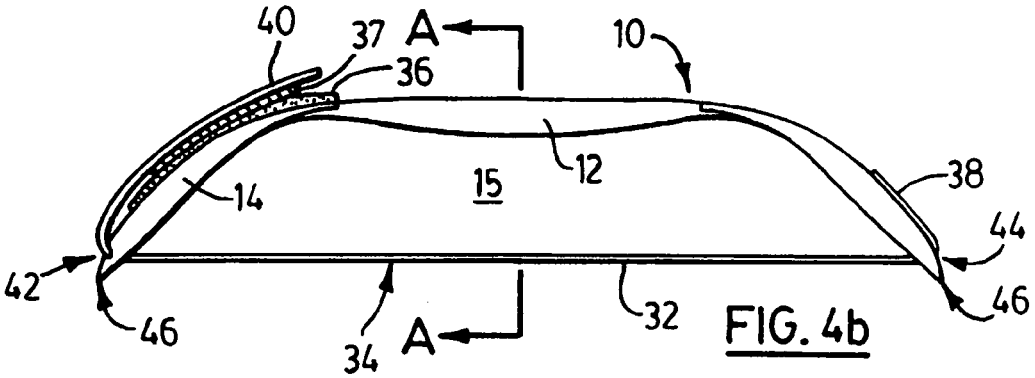
Figure 4C:
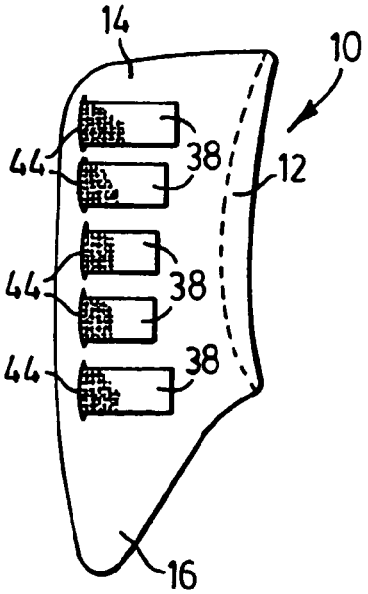
Figure 4D:
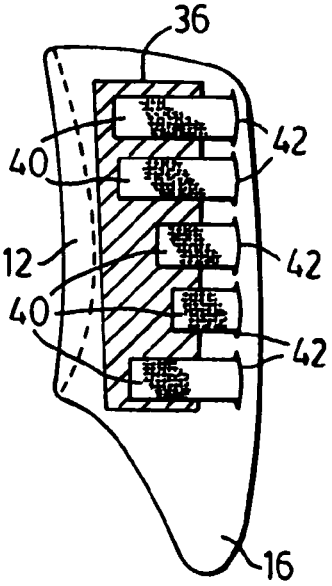
Figure 4E:
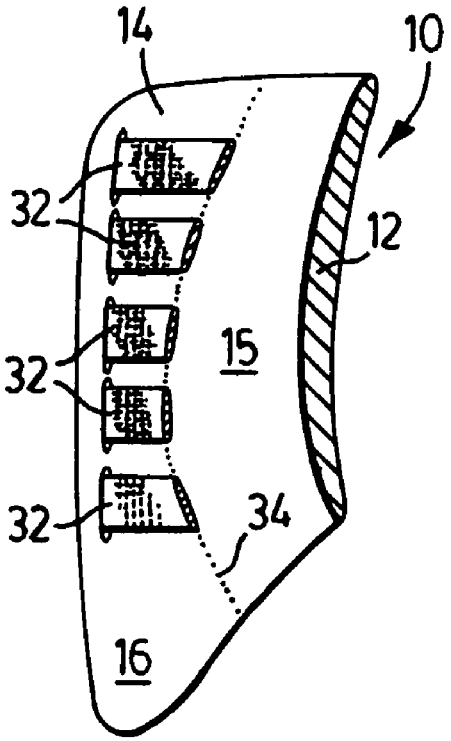
Figure 4F:
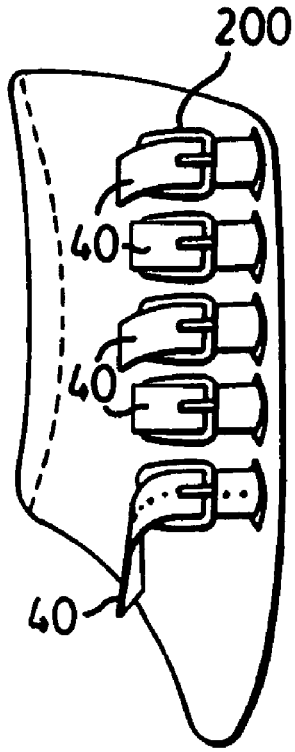
Figure 4G:
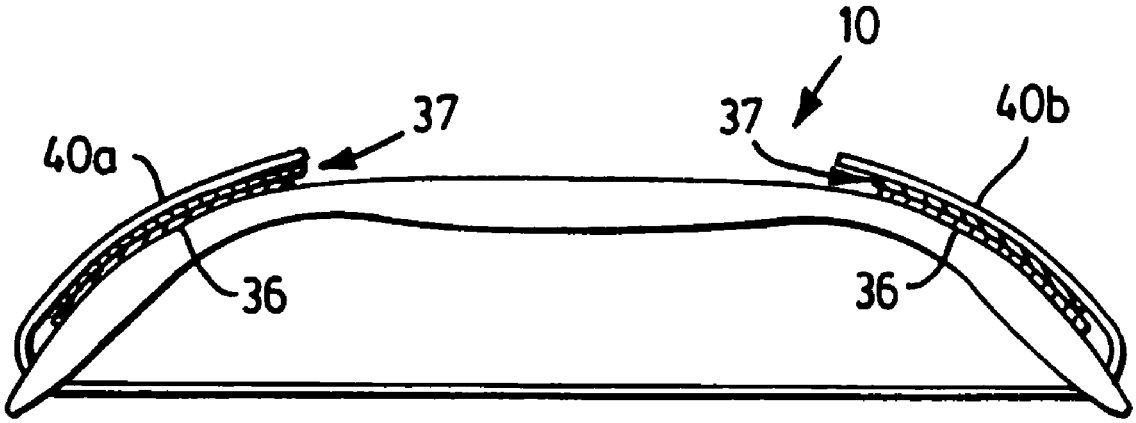

Reference is first made to FIG. 1 and FIGS. 2(*a*) to (*c*), which show a shell 10 for a lumbar support device according to the present invention. FIG. 1 shows a perspective view of the shell 10. FIGS. 2(*a*) to (*c*) show front, top and side views, respectively, of the shell 10. The shell 10 includes a back portion 12 and opposing sides 14. The sides 14 extend forwardly from the back portion 12, as best seen in the top view of the shell 10 in FIG. 2(*b*). Accordingly, the back portion 12 and opposing sides 14 define a hollow 15 or cavity. When employed in a lumber support device, the shell 10 is positioned with the back portion 12 proximate the user's lumbar region and with the sides 14 extending forwardly on either side of the user, so that the user's lumbar region is positioned partially within the hollow 15.

Each of the two sides 14 include a downwardly extending leg portion 16 that protrudes below the back portion 12. As a result, there is a cutout 18 between the two legs 16 below the back portion 12, as best seen in the front view shown in FIG. 2(*a*). When the shell 10 is in use as a lumbar support device, the legs 16 rest upon the seat and position the device above the seat so as to locate it in the user's lumbar region. A device employing the shell 10 need not be attached to the chair back through belts or other mechanisms because the legs 16 support the device in its position against the back of the chair.

The cutout 18 between the legs 16 accommodates the protrusion of the user's buttocks below the back portion 12 of the device and thereby avoids pushing the user forward on a chair seat. Accordingly, a user may assume a normal seated position on the chair, with his or her buttocks and upper back in contact with the chair back, despite the presence of the shell 10 in the lumbar region. The opposing legs 16 also enable the device to be used with a variety of different chairs.

The inner surface 26 of the back portion 12 is formed to be convex, as seen in the side view shown in FIG. 2(*c*). The back portion 12 also has a top edge 28 and a bottom edge 30 that is flared slightly outwards, away from the user. The flaring of the top and bottom edges 28, 30 may be incorporated into the convex curvature of the inner surface 26.

The inner surface of the sides 14 may also be curved. In the embodiment show in FIGS. 1 and 2(*a*) to (*c*), the sides 14 are formed to be concave on their inner surfaces. The curvature of the back portion 12 and of the sides 14 provides additional structural integrity to the shell 10.

Each side 14 has an upper edge 20 and a lower edge 22, and in one embodiment the upper and lower edges 20, 22 are flared outwards away from the user. The flaring of the edges 20, 22, 28, and 30 angles them away from the user to improve comfort in case the user comes into contact with one of the edges 20, 22, 28, and 30.

The shell 10 is formed from a rigid and inelastic material, such as a hard plastic, fibreglass, metal, or wood. Other appropriate natural or synthetic materials will be recognized by those of ordinary skill in the art when considered in conjunction with this description. The shell 10 may be formed using injection molding, or another appropriate manufacturing process.

Figure 3:
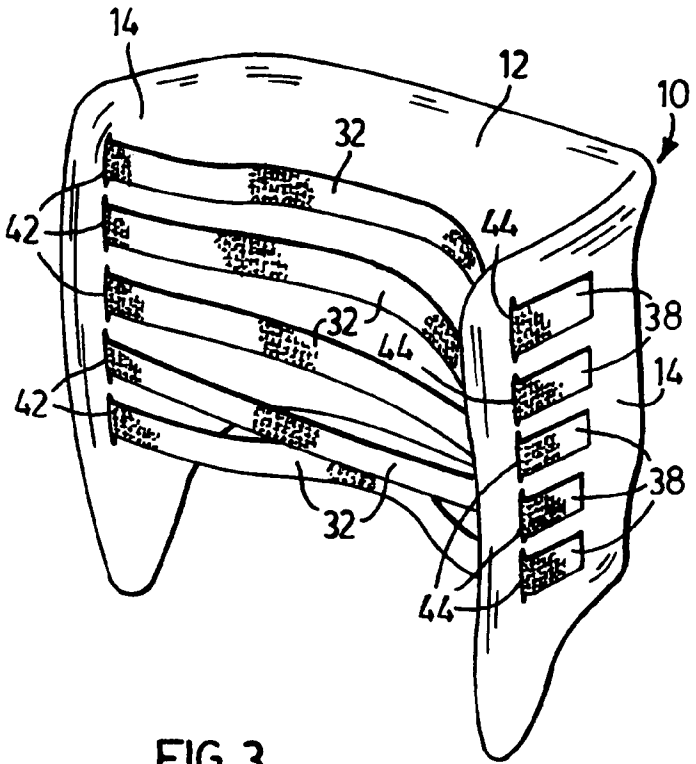
FIG. 3 shows a perspective view of a shell and straps for a lumbar support device according to the present invention.

Reference is now made to FIG. 3 and FIGS. 4(*a*) to (*e*), which show the shell 10 with a plurality of straps 32. FIG. 3 shows a perspective view of the shell 10 and the straps 32. FIGS. 4(*a*) to (*d*) show front, top, right side and left side views, respectively, of the shell 10 and the straps 32. FIG. 4(*e*) shows a cross-sectional side view of the shell 10 and the straps 32 taken along the line A-A.

The straps 32 are disposed horizontally across the hollow 15 and spaced vertically from each other. The ends of each strap 32 are attached one to each side 14 of the shell 10. The straps 32 thereby define a surface (shown in cross-section by the dotted line 34 in FIG. 4(*e*)) extending between the sides 14 of the shell 10. If each strap 32 is secured tightly across the hollow 15 such that the straps 32 have no slack in them, then the surface 34 defined by the straps 32 will be substantially flat. If the straps 32 are arranged to be longer than the span of the two sides 14, each one having some slack in it, then the surface 34 defined by the straps 32 will have some curvature to it, as is shown in FIG. 4(*e*). In this case, when a user places a lumbar support device having the shell 10 and straps 32 onto his or her lumbar region, the user's lumbar region will exert pressure on the straps 32 such that they are pushed back into the hollow 15 and assume the curved surface 34 shown in FIG. 4(*e*). The straps 32 are inelastic and do not stretch to mold to the user's back, but rather assist in molding the user's back to the surface 34, as will be further detailed below. The adjustable length of each of the straps 32 serves to provide the surface 34 with an adjustable vertical contour for customizing the device to a particular user.

Each strap 32 is attached to the shell 10 in a manner that provides for adjustment of the length of the strap 32, and thus the amount of slack in the strap 32. In one embodiment, a fixed end 38 of each of the straps 32 is fixedly attached to one side 14 of the shell 10 and a free end 40 of each of the straps 32 is adjustably attached to the other side 14 of the shell 10. Accordingly, a user may adjust the length of each individual strap 32 by adjusting its point of attachment to the shell 10. In another embodiment, the straps 32 could be adjustably attached to both sides 14 of the shell 10, allowing adjustment of either point of attachment. For example, reference may be made to FIG. 4*g*, which shows an embodiment wherein a first free-end 40*a* of the strap and a second free-end 40*b* of the strap are both adjustably attached to the sides of the shell 10.

The free ends 40 of the straps 32 are adjustably attached to the shell 10 through a hook-and-loop mechanism, such as Velcro™. One portion of the hook-and-loop mechanism, such as a patch of loops 36, is securely affixed to the outer surface of the shell 10 on one side 14. The patch of loops 36 may be affixed to the shell 10 by way of an adhesive or other appropriate material. The free end 40 of each of the straps 32 includes a corresponding patch of hooks 37 to matingly engage the loops 36. The user may adjust the length of any individual strap 32 by changing where the free end 40 attaches to the patch of loops 36 on the shell 10. Similarly, in the embodiment shown in FIG. 4*g*, the user may adjust where either free-end 40*a* or 40*b* attaches to the shell 10 by adjusting the corresponding hooks 37 and loops 36.

Other mechanisms for adjustably attaching the straps 32 to the shell 10 will be apparent to those of ordinary skill in the art, and will include buckles, clamps and other fasteners. For example, reference may be made to FIG. 4*f*, which shows the free-end 40 of the straps attached to the shell using a buckle 200.

The free end 40 of each strap 32 may pass through a slit 42 in the side 14 of the shell 10, as shown in FIG. 4(*d*). Similarly, the fixed end 38 of each strap 32 may pass through a corresponding slit 44 in the other side 14 of the shell 10, as shown in FIG. 4(*c*). In another embodiment, the straps 32 do not pass through slits 42, 44, but instead they wrap over the outer edge 46 of the sides 14. Depressions or slots may be provided in the outer edge 46 to assist in arranging the straps 32 in the correct vertical position.

The straps 32 are composed of a flexible inelastic material. Suitable materials may include nylon webbing, leather, certain plastics, or coated wire. Other suitable materials will be apparent to those of ordinary skill in the art. In one embodiment, the straps 32 are approximately one inch wide and are vertically spaced approximately a quarter-inch to a half-inch apart from each other.

Those of ordinary skill in the art will appreciate that other materials and arrangements may be employed to provide for the adjustable surface 34 between the two sides 14 of the shell 10.

Figure 5:
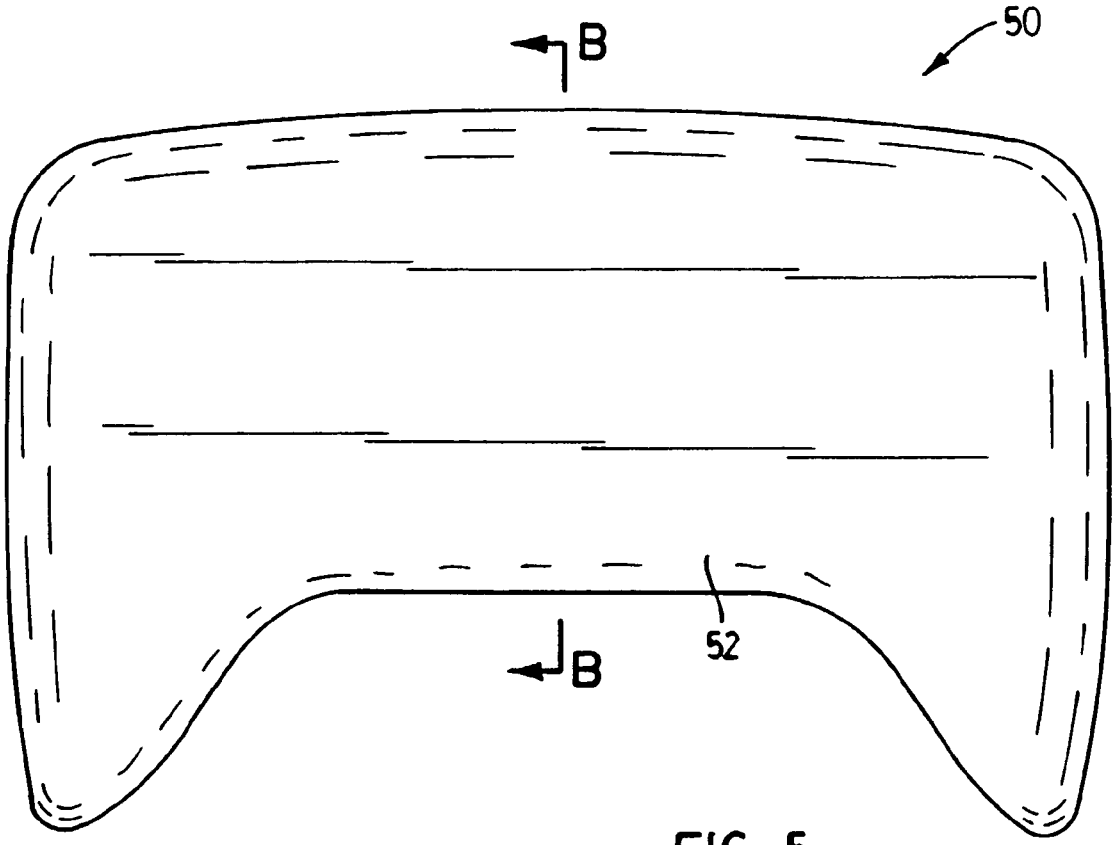
FIG. 5 shows a front view of a lumbar support device according to the present invention.
Figure 6:
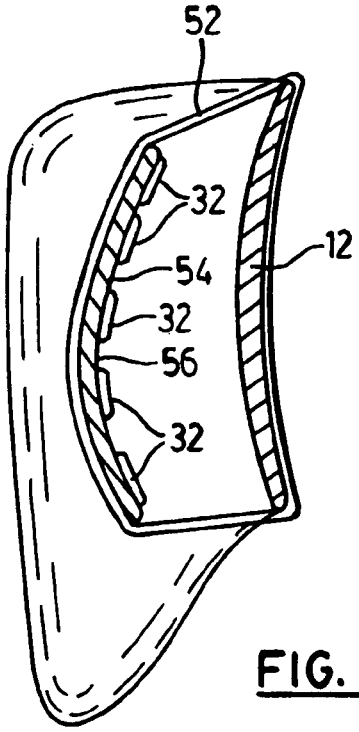
FIG. 6 shows a cross-sectional view of the lumbar support device from FIG. 5 along the lines B-B.

Reference is now made to FIG. 5 which shows a front view of a lumbar support device 50 according to the present invention, and FIG. 6 which shows a cross-sectional view of the lumbar support device 50 along the lines B-B. The lumbar support device 50 includes the shell 10 and the straps 32 and further includes a covering 52. The covering 52 is made of a stretchable material having elasticity and sized to stretch flush to the volume defined by the shell 10 and straps 32. The covering 52 is removable to allow for cleaning and repair to the covering 52, the shell 10 or the straps 32. The covering 52 may be created from a polyester-based fabric, a thin rubber, or any other suitable natural or synthetic fabric, including the Lycra™ synthetic fabric developed by E.I. Du Pont De Nemours and Company, Wilmington, Del.

The lumbar support device 50 also includes a padding 54 between the straps 32 and the covering 52. The padding 54 provides a measure of cushioning for the user's back to improve comfort. The inner surface 56 of the padding 54 that contacts the straps 32 may be provided with a non-stick slippery coating, such as a slippery cloth, to ensure the straps 32 can glide over the padding 54 as they are adjusted. In one embodiment, the padding 54 is approximately one half inch thick.

Figure 7:
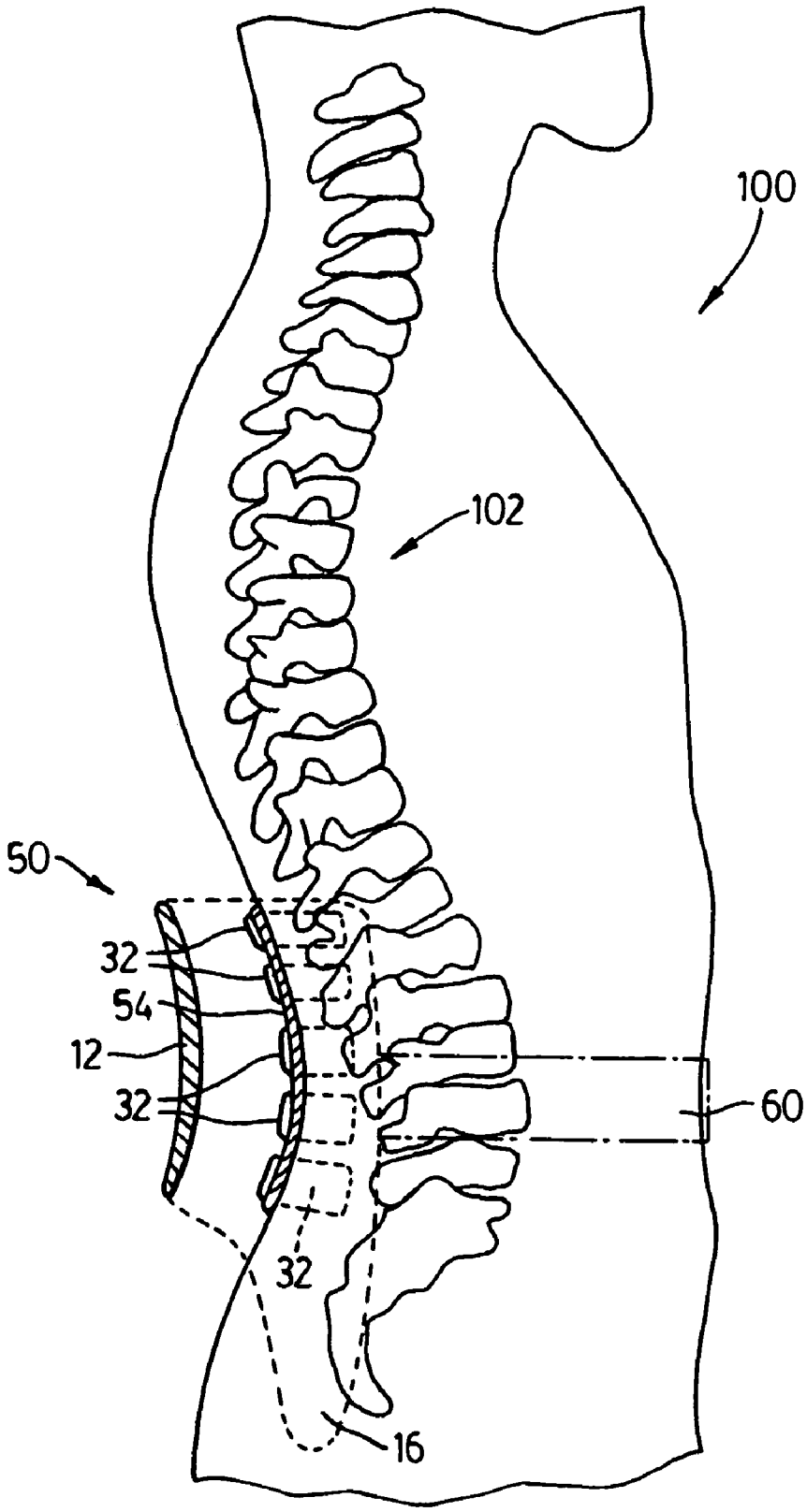
FIG. 7 shows a cross-sectional side view of a user standing erect with the lumbar support device positioned in his or her lumbar region.

Reference is now made to FIG. 7, which shows a cross-sectional side view of a user 100 standing erect with the lumbar support device 50 positioned in his or her lumbar region. With the user 100 standing comfortably erect in a position of good posture, the user's 100 spine 102 assumes a "neutral" position. The neutral position of the spine 102 is a desirable position for alleviating back and neck strain and for preventing repetitive strain injuries encountered due to prolonged sitting activities. Each user 100 will have a unique individual neutral position that is arrived at by standing fully erect in a proper postural position.

Once the user 100 has assumed a neutral position and the device 50 is placed in the user's lumbar region, the straps 32 are adjusted so that they conform to the contour of the user's 100 back. In one sense, the user's 100 neutral position is "mapped" onto the device 50 by adjusting the length of the straps 32. The device 50 is then capable of "remembering" the user's 100 neutral position and can reassume that position the next time the user 100 places the device 50 against his or her lumbar region.

The device 50 may include a belt 60 for securing the device 50 in place against the user's 100 lumbar region, when the user 100 is in a standing position. The belt 60 may later also be used to secure the device 50 to a chair.

Figure 8:
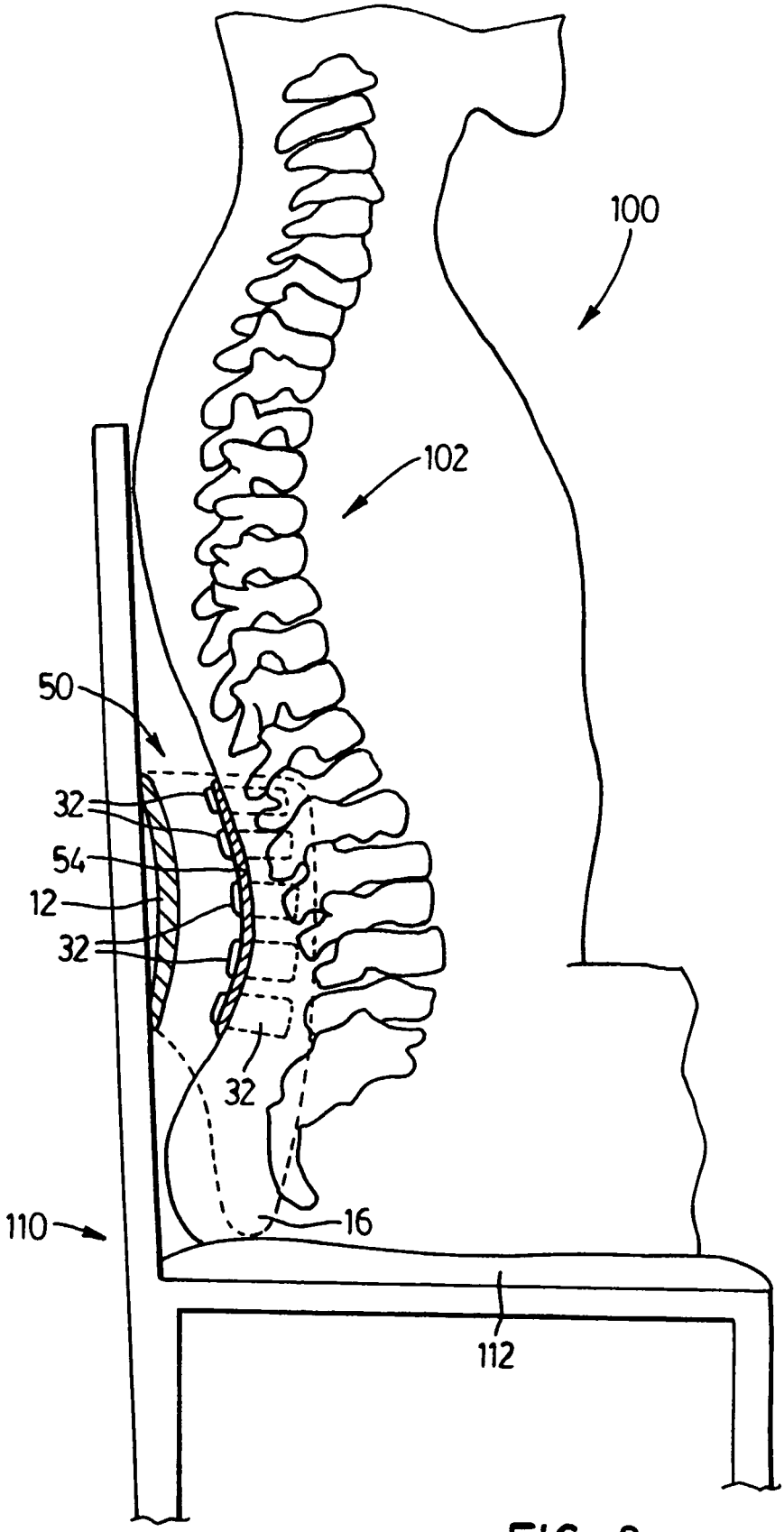
FIG. 8 shows a cross-sectional side view of the user seated in a chair and using the lumbar support device in accordance with the present invention.

Reference is now made to FIG. 8, which shows a cross-sectional side view of the user 100 seated in a chair 110 and using the lumbar support device 50 in accordance with the present invention.

The device 50 may be positioned in the chair 110 with the legs 16 resting on the seat 112 of the chair 110. The legs 16 support the device 50 and position the straps 32 above the seat 112 at the user's 100 lumbar region, but accommodate the user's 100 buttocks between them. Accordingly, the user 100 may sit with his or her buttocks in normal position on the seat 112 of the chair 110, yet have the device 50 positioned in his or her lumbar region to reinforce the neutral positioning of the spine 102.

When the user 100 sits in the chair 110, the device 50 corrects the user's 100 positioning, teaching the user 100 to assume the neutral position. The device 50 does not conform to the user's 100 position, but rather enforces the user's 100 pre-fitted neutral position. If the user 100 is not able to fully assume the neutral position while seated due to a lack of pelvic flexibility, the straps 32 can be slightly loosened to allow for the gradual learning of the correct sitting neutral position.

Figure 9A:
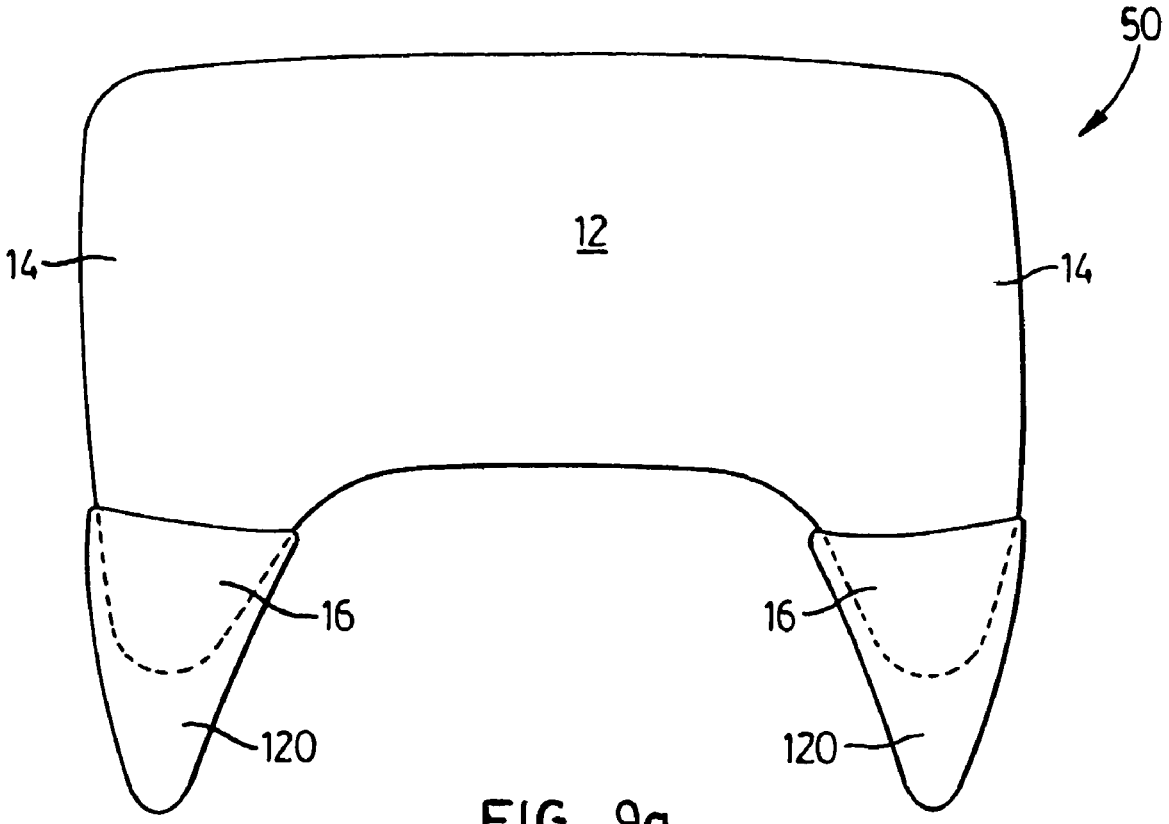
FIGS. 9(*a*) and (*b*) show a front and a side view of the lumbar support device with leg extensions.
Figure 9B:
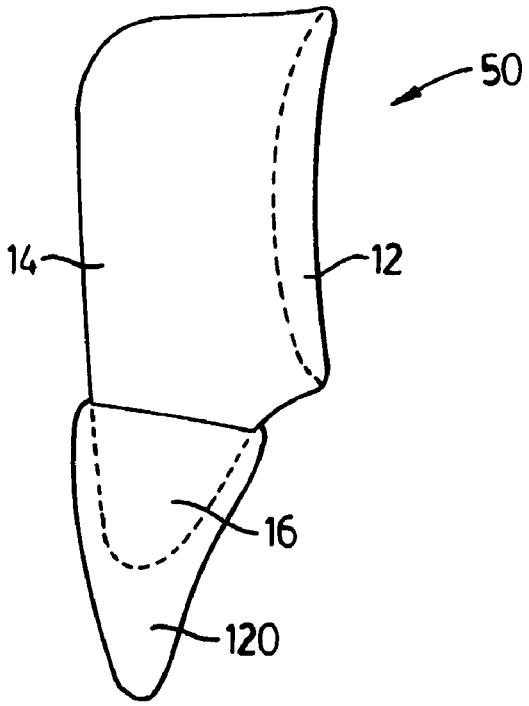

Reference is now made to FIGS. 9(*a*) and (*b*), which show the device 50 with leg extensions 120 so as to allow for an increase in the height of the device 50 when resting on the seat 112 of the chair 110. The leg extensions 120 may be removably attached to the sides 14 of the device 50 in a variety of manners, including through various releasable fastening mechanisms, such as hook-and-loop or snap-fit. Shown in FIGS. 9(*a*) and (*b*) is an embodiment wherein the leg extensions 120 have an open end that securely fits over the legs 16 of the device 50.

The leg extensions 120 may be formed from rubber, wood, plastic, wire, steel, or a number of other materials, as will be understood by those of ordinary skill in the art. The device 50 may be provided with a plurality of leg extensions 120 so as to provide a plurality of adjustable heights for the device 50.

In another embodiment (not shown), the leg extensions 120 are incorporated into the device 50 as adjustable legs. The adjustable legs are downwardly extensible so as to alter the height of the device 50. The adjustable legs may include a telescoping sliding mechanism. Other mechanisms and embodiments for providing the device 50 with adjustable leg height will be understood by those of ordinary skill in the art.

The present invention may be embodied in other specific forms without departing from the spirit or essential characteristics thereof. Certain adaptations and modifications of the invention will be obvious to those skilled in the art. Therefore, the above discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. A lumbar support device comprising:

a rigid shell having a back portion between opposing sides, the sides extending forwardly of the back portion and defining a hollow, the rigid shell being formed from a rigid inelastic material; and an inelastic lumbar support surface for engaging a user's lumbar region having one end attached to one of the sides of the rigid shell and another end attached to the other side of the rigid shell such that the surface partially encloses the hollow, said surface having an adjustable surface contour configured to be adjusted to conform to a neutral postural position of said user's lumbar region such that the lumbar support device adjusted to conform to said neutral postural position, reinforces said neutral postural position.

2. The lumbar support device claimed in claim 1, wherein said adjustable surface contour includes an adjustable horizontal length between said opposing sides.

3. The lumbar support device claimed in claim 2, wherein said adjustable horizontal length includes a spaced apart plurality of individually adjustable horizontal lengths.

4. The lumbar support device claimed in claim 1, wherein said surface comprises a plurality of inelastic straps, each of said straps spanning from one of the sides to the other side, and each of said straps having an adjustable length.

5. The lumbar support device claimed in claim 4, wherein each of said straps has a fixed end and a free end, said fixed end being affixed to said one of the sides and said free end being adjustably attached to said other side.

6. The lumbar support device claimed in claim 5, further including an adjustable attachment mechanism for adjustably attaching said free ends of said straps to said shell and varying the lengths of said straps.

7. The lumbar support device claimed in claim 6, wherein said adjustable attachment mechanism is a hook-and-loop fastener.

8. The lumbar support device claimed in claim 6, wherein said adjustable attachment mechanism is a buckle.

9. The lumbar support device claimed in claim 4, wherein each of said straps has a first free end and a second free end, said first free end being adjustably attached to said one of the sides and said second free end being adjustably attached to said other side.

10. The lumbar support device claimed in claim 1, wherein said back portion includes a convex inner surface between said opposing sides, and wherein said sides include concave inner surfaces.

11. The lumbar support device claimed in claim 10, wherein said back portion includes a top edge and a bottom edge, extending between said opposing sides, and wherein said top and bottom edges are flared outwards.

12. The lumbar support device claimed in claim 1, where said rigid shell is formed with a material selected from the list including plastic, fiberglass, metal or wood.

13. The lumbar support device claimed in claim 1, further including two legs, each of said legs depending downwardly from a respective one of said opposing sides, the legs defining a gap below the back portion and thereby accommodating the protrusion of a user's buttocks through the gap below the back portion.

14. The lumbar support device claimed in claim 13, wherein said legs include extensions for adjusting the length of said legs.

15. The lumbar support device claimed in claim 13, wherein said legs and said opposing sides are integrally formed.

16. The lumbar support device claimed in claim 1, further including a belt attached to said shell for securing said device about a user's waist.

17. The lumbar support device claimed in claim 1, further including an elastic fabric covering for the device.

18. The lumbar support device claimed in claim 17, further including a padding disposed between said surface and said covering.

19. A lumbar support device, comprising:

a rigid shell having opposing sides and an inelastic lumbar support surface between said sides for engaging a user's lumbar region, the lumbar support surface having an adjustable surface contour configured to be adjusted to conform to a neutral postural position of said user's lumbar region such that the lumbar support device adjusted to conform to said neutral postural position, reinforces said neutral postural position; and two legs, each of said legs depending downwardly from a respective one of said opposing sides, the legs defining a gap below the body and thereby accommodating the protrusion of the user's buttocks through the gap below the body.

20. The lumbar support device claimed in claim 19, wherein said legs include extension means for adjusting the height at which the device is raised above the chair seat.

21. The lumbar support device as claimed in claim 19, wherein said body includes a rigid shell having a back portion between said opposing sides, said sides extending forwardly of the back portion and defining a hollow, and a lumbar support surface having one end attached to one of the sides and another end attached to the other side such that the surface partially encloses the hollow, said surface having an adjustable surface contour.

22. The lumbar support device as claimed in claim 19, wherein said legs and said opposing sides are integrally formed.

23. The lumbar support device as claimed in claim 19, wherein said legs are coupled to said sides through an extensible mechanism, and said extensible mechanism adjusts said legs between a proximate position near said sides and a distal position distant from said sides, thereby altering the height of the lumbar support device.

24. The lumbar support device as claimed in claim 19, wherein said legs are removably attached to said sides.

25. A method of reinforcing a user's neutral postural position comprising:

obtaining lumbar support device comprising:

a rigid shell having a back portion between opposing sides, the sides extending forwardly of the back portion and defining a hollow, the rigid shell being formed from a rigid inelastic material; and an inelastic lumbar support surface for engaging a user's lumbar region having one end attached to one of the sides of the rigid shell and another end attached to the other side of the rigid shell such that the surface partially encloses the hollow, said surface having an adjustable surface contour;

adjusting said inelastic lumbar support surface to conform to a neutral postural position of said user's lumbar region; and placing said lumbar support device adjusted to conform to said neutral postural position against the user's lumbar region such that the lumbar support device reinforces said neutral postural position.

26. The method of reinforcing a user's neutral postural position as claimed in claim 25, wherein said inelastic lumbar support surface comprises a plurality of inelastic straps, each of said straps spanning from one of the sides to the other side, and each of said straps having an adjustable length.

27. The method of reinforcing a user's neutral postural position as claimed in claim 25, wherein the lumbar support device further includes two legs, each of said legs depending downwardly from a respective one of said opposing sides, the legs defining a gap below the back portion and thereby accommodating the protrusion of a user's buttocks through the gap below the back portion.

* * * * *

UNITED STATES PATENT AND TRADEMARK OFFICE

CERTIFICATE OF CORRECTION

PATENT NO. : 7,651,163 B2
APPLICATION NO. : 10/308147
DATED : January 26, 2010
INVENTOR(S) : Jan Jaskot et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1,575 days.

Signed and Sealed this
Eighth Day of February, 2011

David J. Kappos

David J. Kappos
*Director of the United States Patent and Trademark Office*